United States Patent [19]

Vesterlund

[11] Patent Number: 4,779,383

[45] Date of Patent: Oct. 25, 1988

[54] DEVICE FOR MACHINING THE DRYING CYLINDERS OF A PAPER MACHINE

[75] Inventor: Ingmar Vesterlund, Pyhäjoki, Finland

[73] Assignee: Maire Rautio, Pyhäjoki, Finland

[21] Appl. No.: 84,825

[22] PCT Filed: Oct. 9, 1986

[86] PCT No.: PCT/FI86/00113

§ 371 Date: Jul. 10, 1987

§ 102(e) Date: Jul. 10, 1987

[87] PCT Pub. No.: WO87/02281

PCT Pub. Date: Apr. 23, 1987

[30] Foreign Application Priority Data

Oct. 10, 1985 [FI] Finland ..... 853945

[51] Int. Cl.[4] ..... B24B 21/02

[52] U.S. Cl. ..... 51/179; 409/178; 409/199; 51/241 S

[58] Field of Search ..... 51/251, 252, 253, 254, 51/241 S, 170 R, 179; 409/178, 199

[56] References Cited

U.S. PATENT DOCUMENTS

| | | | |
|---|---|---|---|
| 1,088,424 | 2/1914 | Hurley | 51/253 |
| 1,174,213 | 3/1916 | White | 51/170 R |
| 2,461,459 | 2/1949 | Wilkes | 51/252 |
| 2,579,391 | 12/1951 | Minarik et al. | 51/251 |
| 2,651,152 | 9/1953 | Schnuck | 51/251 |
| 4,575,972 | 3/1986 | Ohki et al. | 51/251 |

FOREIGN PATENT DOCUMENTS

| | | | |
|---|---|---|---|
| 135211 | 11/1933 | Austria | 51/254 |
| 822448 | 10/1984 | Finland . | |
| 2135609 | 9/1984 | United Kingdom . | |

*Primary Examiner*—Roscoe V. Parker
*Attorney, Agent, or Firm*—Ladas & Parry

[57] ABSTRACT

A device for the machining of the shell surfaces of the drying cylinders of a paper machine and particularly for the grinding thereof, which device comprises a carriage (1) which is displaceable in the direction of the length of the drying cylinders and to which a grinder is attached. In order that the grinding could be carried out easily and rapidly and with only a short downtime of the paper machine, the carriage of the device is formed by a frame carriage (1) which is provided with supporting elements (13) for the support thereof both against a drying cylinder (9) of the paper machine and against a second cylinder (10) of the paper machine so that it is positioned between said cylinders (9, 10) when the device is in operation. There are preferably eight supporting elements (13, 14) provided, four of which are arranged to be positioned against the drying cylinder (9) to be ground and the other four against the second cylinder (10). The supporting elements (13, 14) are provided with rotating balls, roller wheels or slide surfaces so that the cylinders (9, 10) of the paper machine are rotatable during the grinding process.

10 Claims, 2 Drawing Sheets

DEVICE FOR MACHINING THE DRYING CYLINDERS OF A PAPER MACHINE

The invention relates to a device by means of which the shell surfaces of the drying cylinders in a paper machine can be machined and particularly ground without having to detach the drying cylinders from the paper machine. It is of advantage to use this kind of device when a worn, dirty, or otherwise uneven shell surface of a drying cylinder is to be repaired by machining.

It is known to carry out grinding by means of a method wherein a separate body beam is mounted beside the drying cylinder, and the body beam is provided with guide rails on which a grinder secured on a displacing carriage is supported for the grinding of the shell surface of the drying cylinder. The repair grinding is difficult to carry out by means of this method, because the body beam must be steady, whereby it of necessity is heavy and the mounting thereof is both laborous and difficult. Further, the apparatus itself is very difficult to fasten on the object to be ground. The repair grinding of the shell surface of the drying cylinder thus takes plenty of time, and is difficult to carry out.

Finnish Patent Specification No. 822,448 discloses a grinder the body of which is formed e.g. by a felt roll on an adjacent drying cylinder to which guide rails are attached by means of clamp frames, magnets or some other fastening means, by virtue whereof the grinder is light and the mounting thereof is fairly easy to carry out. However, bringing the device into working order is accurate work, wherefore it often takes plenty of time, too.

Further, the prior art methods and devices for grinding a drying cylinder are disadvantageous in that the wire must be removed from the drying cylinder in order that the grinding could be carried out, which lengthens the highly costly downtime of the paper machine.

The object of the novel machining device according to the invention is to eliminate the above-mentioned disadvantages. For the achievement thereof the invention is characterized in that the carriage comprises a frame carriage which is provided with supporting elements by means of which the frame carriage is supported both on a drying cylinder of the paper machine and on a second cylinder of the paper machine between said cylinders when the device is in operation.

By virtue of the device according to the invention the grinding work can be carried out easily and rapidly, whereby the paper machine has to be put out of operation only for a short period of time.

Figure 1:
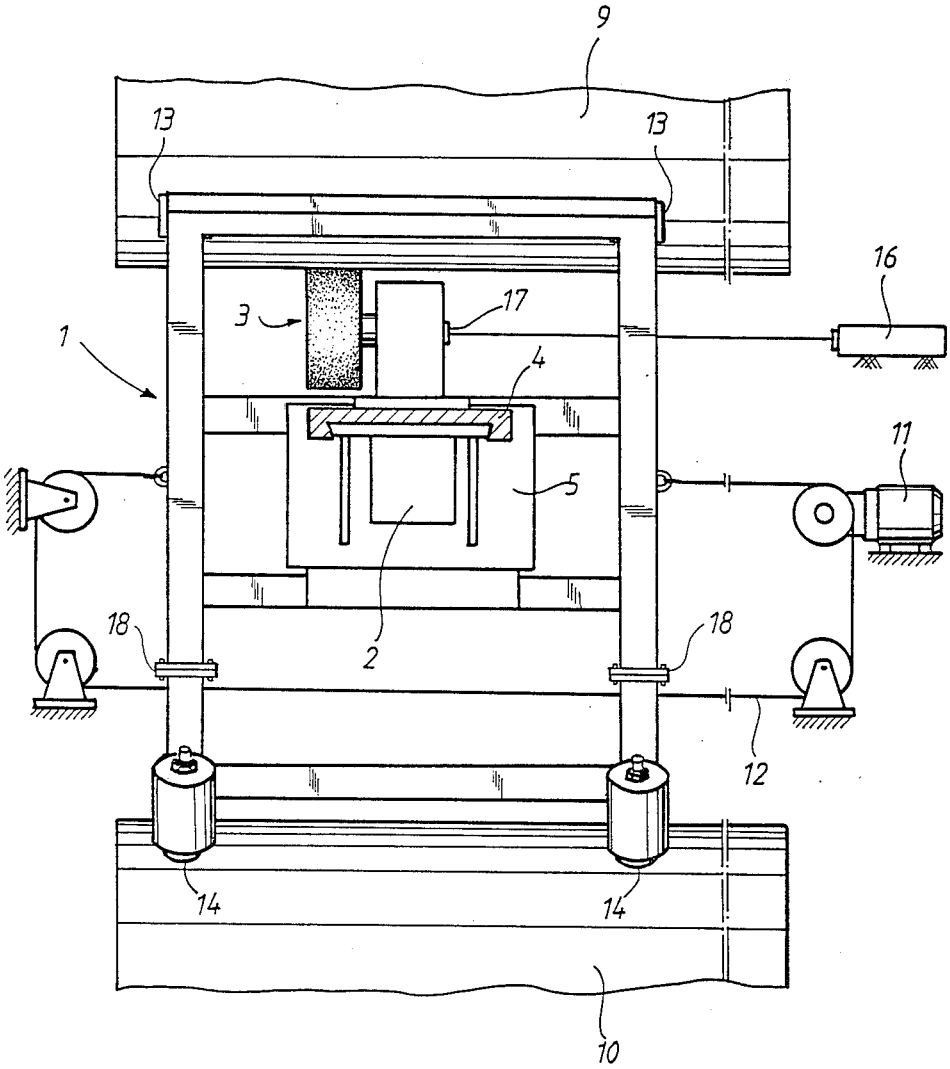
Figure 2:
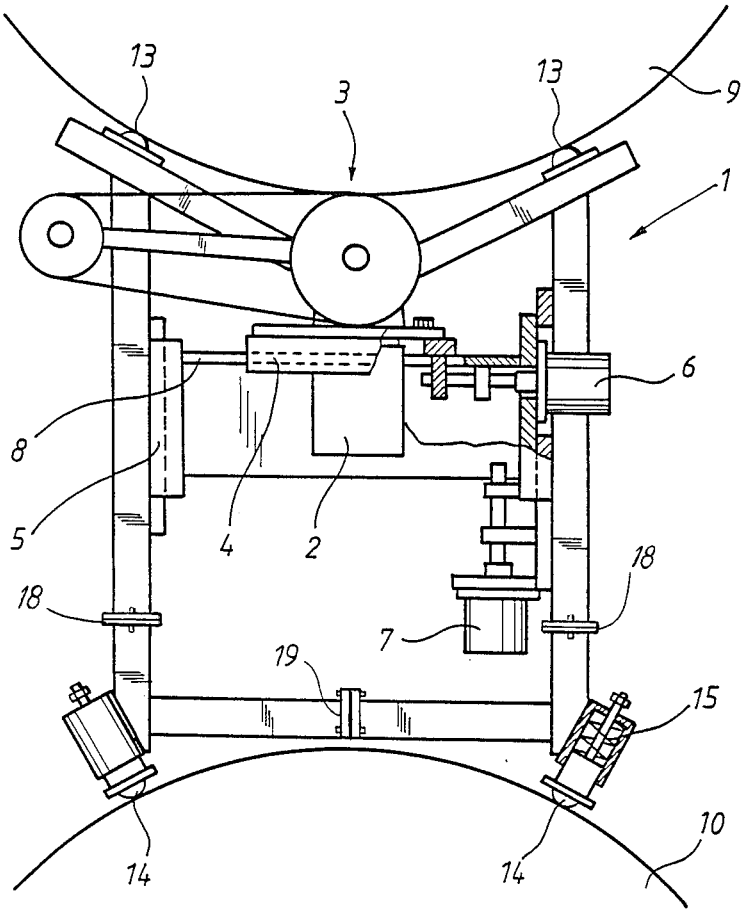

The invention will be described in detail in the following by means of one preferred embodiment thereof with reference to the attached drawings, wherein FIG. 1 illustrates the machining device in a side view, i.e. perpendicularly to the longitudinal axis of the drying cylinder, and FIG. 2 illustrates the machining device in a partial sectional view seen in the direction of the longitudinal axis of the drying cylinder.

In FIGS. 1 and 2 the frame carriage of the machining device is indicated generally by the reference numeral 1. An abrasive belt grinder (a stone grinder is also possible) operated by a motor 2 is positioned within the frame carriage 1 and indicated generally by the reference numeral 3. The position of the abrasive belt grinder 3 can be adjusted by means of a horizontal carriage 4 and a vertical carriage 5, and the both carriages are operated by their own displacing motors 6 and 7. The abrasive belt grinder 3 is attached to the horizontal carriage 4, which is displaced on guides 8 and attached to the vertical carriage 5. In the figures the frame carriage 1 is fitted between two adjacent drying cylinders 9 and 10 of the paper machine, of which cylinders the upper one 9 is exposed to the grinding operation. As appears from FIG. 1, the displacement of the frame carriage 1 in the longitudinal direction of the drying cylinder is carried out by means of a displacing motor 11 which is separate from the frame carriage, e.g. attached to the frame of the paper machine. The displacing motor 11 operates the frame carriage by means of a displacing chain 12.

The frame carriage 1 comprises two parts so that it is easy to mount between the drying cylinders 9 and 10; i.e. the frame carriage is assembled in situ of two parts which are attached to each other. The two parts of the frame carriage 1 are formed e.g. in such a way that each vertical beam thereof is formed by two pieces and provided with connecting flanges 18 positioned in the lower portion of the frame carriage, whereby the flanges and the vertical beams are interconnected by means of a bolted joint when the frame carriage is assembled and detached from each other when the frame carriage is disassembled. The horizontal beams of the frame carriage 1 can also be provided with connecting flanged 19 for facilitating the mounting. It is possible to replace said flanges by hinge-type joints. In view of the mounting, an alternative structure would be such that the beams of the frame carriage are e.g. telescopic, whereby the height of the frame carriage is easily adjustable. The frame carriage 1 of the machining device is arranged to be supported between the drying cylinders 9 and 10 on eight supporting elements 13 and 14. The supporting elements 13 and 14 are provided with rotating balls, roller wheels, or slide blocks so that the cylinders 9 and 10 are able to rotate during the grinding. The supporting elements 14 positioned against at least the drying cylinder 10 are resilient, whereby the clearances of the machinery and the irregularities of the drying cylinders do not hamper the grinding process. The relilience can be effected e.g. by means of springs, as shown in FIG. 2.

The control of the grinder 3 is based e.g. on the use of a laser transmitter. The laser transmitter, which is indicated by the reference numeral 16 in FIG. 1, is mounted in parallel with the longitudinal axis of the drying cylinder 9. The laser transmitter 16 transmits light towards the grinder 3, to which an identifier 17 is attached, whereby an automatic control (not shown) connected to the laser transmitter determines accurately the position of the grinder, i.e. the distance thereof from the axis of the cylinder 9 to be ground, and ensures that the driving motors 6 and 7 of the horizontal and the vertical carriage control said carriages in such a way that the desired grinding program will be carried out. It is not necessary to control the displacing motor 11 of the frame carriage 1 by means of the laser transmitter, because it may rotate at a determined, preset constant speed during the entire grinding process. In place of the laser control, optical devices can be utilized in the control of the horizontal and the vertical motor 6 and 7, by means of which devices it is possible to observe the path of the grinder 3 and manually correct it, if necessary. Alternatively, the control can be effected by means of a wire which is tightened in parallel with the longitudinal axis of the drying cylinder to be ground, whereby a sensor is utilized for maintaining the movement of the grinder parallel to the tightened wire.

The system according to the invention can also be carried out in such a manner that in place of a grinder, a cutter unit, e.g. a turning chisel or a milling cutter, is fastened on the horizontal carriage. By means of the cutter unit the drying cylinder can be machined extremely rapidly. The finishing step, however, must be carried out by grinding.

It has been stated above that the machining device according to the invention is mounted between two drying cylinders of the paper machine; however, it can be alternatively mounted between the drying cylinder to be ground and a felt roll of the paper machine so that the felt roll acts as the second cylinder. The device can easily be constructed so that the grinder thereof can be turned towards a third or a fourth drying cylinder of the paper machine, i.e. towards a cylinder on which the device is not supported, for the grinding of said cylinder(s).

The invention has been described above only by means of one preferred embodiment thereof, and a few possible modifications of the invention have been referred to. However, it is fully possible to realize the invention in a slightly different way within the sphere of the inventive idea defined in the attached claims. For instance, the frame carriage can be formed by more than two parts for facilitating the mounting thereof, and it is, of course, possible to fasten the frame carriage on more than two cylinders.

I claim:

1. A device for the machining for the shell surfaces of the drying cylinders in a paper machine and particularly for the grinding thereof, comprising a carriage (1) which is displaceable in the direction of the length of the drying cylinders and which is provided with supporting elements (13, 14) by means of which it is supported both on a drying cylinder (9) of the paper machine and on a second cylinder (10) of the paper machine and to which a grinder (3) is attached, characterized in that the carriage comprises a frame carriage (1) with eight supporting elements, four of said elements (13) being arranged to support against the first drying cylinder (9) and the other four elements (14) being arranged to support against the second cylinder (10) whereby the frame carriage is supported between said cylinders (9,10) when the device is in operation.

2. A device according to claim 1, characterized in that the supporting elements (13) support the frame carriage (1) against the drying cylinder (9) to be ground and against the second cylinder, which is another dryihg cylinder (10) of the paper machine, whereby the frame carriage is positioned between said drying cylinders (9 and 10).

3. A device according to claim 1, characterized in that the supporting elements (13) support the frame carriage against the drying cylinder (10) to be ground and against the second cylinder, which is a felt roll of the paper machine.

4. A device according to claim 1, characterized in that the supporting elements (13,14) are provided with balls by means of which the supporting elements are supported against said cylinders (9,10).

5. A device according to claim 4, characterized in that the other four supporting elements (14) are pressed against the second cylinder (10) by means of the springs (15).

6. A device according to claim 1, characterized in that the frame carriage (1) comprises a horizontal carriage (4) which is operated by a displacing motor (6) and to which the grinder (3) is attached, and a vertical carriage (5) operated by a displacing motor (7), by means of which carriages (4 and 5) the grinder is displaceable in a plane extending perpendicularly to the longitudinal axis of the drying cylinder (9).

7. A device according to claim 6, characterized in that the horizontal carriage (4) is attached to the vertical carriage (5), and arranged to move on guides (8).

8. A device according to claim 1, characterized in that the frame carriage (1) is formed by two parts which are interconnectable by means of connecting flanges (18) provided on the vertical beams of said carrige, whereby the carriage (1) can be assembled between the cylinders (9 and 10).

9. A device according to claim 1, characterized in that the frame carriage (1) is displaceable in the direction of the length of the drying cylinder (9) to be ground by means of a displacing motor (11) attached separately from the frame carriage, which motor operates the frame carriage by means of a displacing chain (12).

10. A device according to claim 1, characterized in that the displacing motors (6 and 7) of the horizontal and the vertical carriage (4 and 5) are controlled by means of a laser transmitter (16) which transmits light towards an identifier (17) attached to the grinder (3).

* * * * *